US006443463B1

(12) United States Patent
Kubelka

(10) Patent No.: US 6,443,463 B1
(45) **Date of Patent: *Sep. 3, 2002**

(54) ROLLER SKATE AND WHEEL FOR USE ON SUCH A ROLLER SKATE

(75) Inventor: Axel Kubelka, Obdach (AT)

(73) Assignee: Mark Handels, AG, Zurich (CH)

( * ) Notice: Subject to any disclaimer, the term of this patent is extended or adjusted under 35 U.S.C. 154(b) by 0 days.

This patent is subject to a terminal disclaimer.

(21) Appl. No.: 09/627,551

(22) Filed: Jul. 28, 2000

Related U.S. Application Data

(63) Continuation of application No. 09/178,149, filed on Oct. 23, 1998, now Pat. No. 6,113,112, which is a continuation-in-part of application No. 08/578,589, filed as application No. PCT/AT95/00089 on May 5, 1995, now abandoned.

(51) Int. Cl.[7] ..... A63C 17/06
(52) U.S. Cl. ..... 280/11.19; 301/5.3
(58) Field of Search ..... 280/11.22, 11.27, 280/11.28, 11.19, 842; 301/5.3, 5.7

(56) References Cited

U.S. PATENT DOCUMENTS

| | | | | |
|---|---|---|---|---|
| 698,110 A | | 4/1902 | Foy | |
| 1,778,850 A | * | 10/1930 | Duisenberg | 280/11.22 |
| 2,570,349 A | * | 10/1951 | Kardhordo | 301/5.3 X |
| 4,898,403 A | * | 2/1990 | Johnson | 301/5.7 X |
| 5,046,746 A | * | 9/1991 | Gierveld | 280/11.22 |
| 5,207,454 A | | 5/1993 | Blankenburg | |
| 5,401,037 A | * | 3/1995 | O'Donnell et al. | 280/11.2 |
| 5,411,320 A | * | 5/1995 | Alderman | 301/5.3 |
| 5,573,309 A | * | 11/1996 | Bekessy | 301/5.3 |
| 5,676,428 A | * | 10/1997 | St. Laurent | 301/5.3 |
| 6,113,112 A | * | 9/2000 | Kubelka | 280/11.22 |

* cited by examiner

*Primary Examiner*—Eric Culbreth
*Assistant Examiner*—Christopher Bottorff
(74) *Attorney, Agent, or Firm*—Lackenbach Siegel, LLP

(57) ABSTRACT

An in-line roller skate assembly having at least three running rollers that are substantially equal in diameter and disposed one behind the other in a running direction of the skate assembly. Each running roller has a convex shaped rolling surface with a pair of laterally spaced curved shoulder portions having a common radius of curvature as defined in a plane intersecting a rotational axis of the respective roller. The radius of curvature of the curved shoulder portions of the front and rear rollers are greater than a radius of curvature of each curved shoulder portion of the intermediate roller or rollers.

8 Claims, 2 Drawing Sheets

Figure 1:
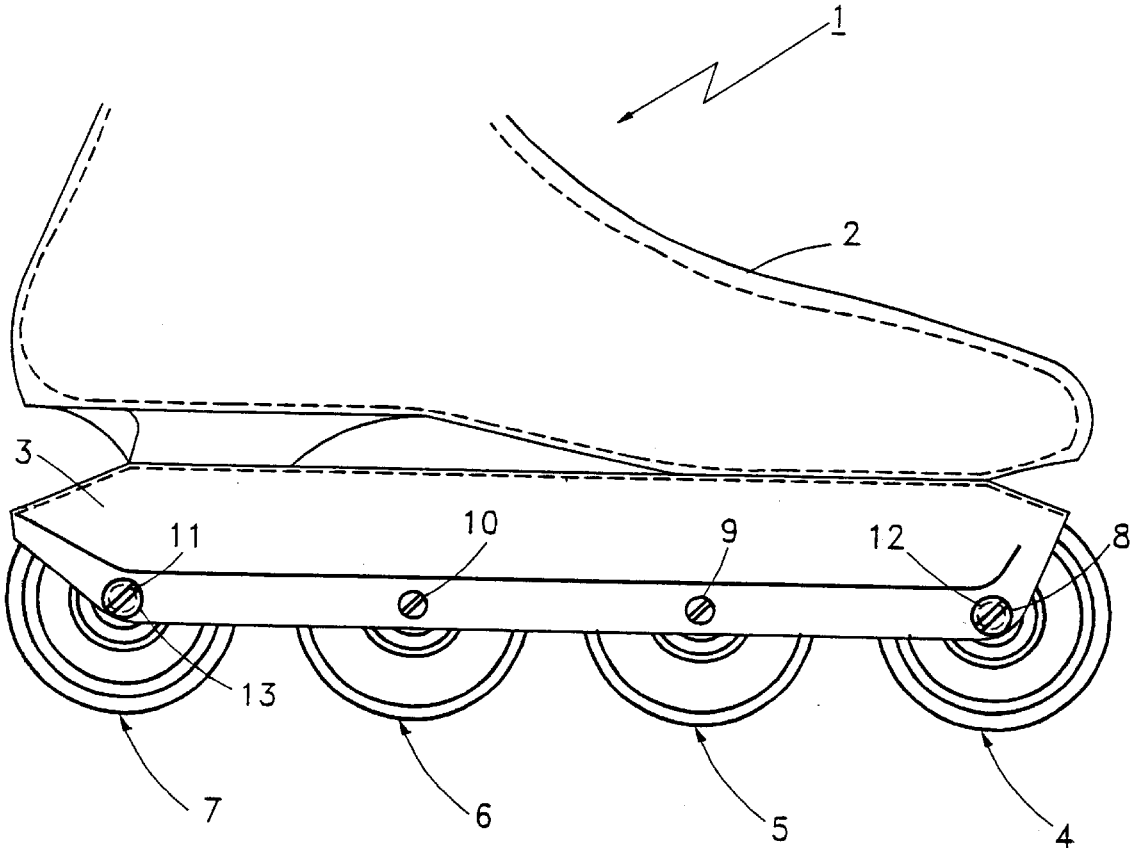

5,6
4,7
a
d
α

E
16
14
a
18

E
17
15
5r,6r
19
5s,6s
a
5,6
5m,6m
20

E
7
6
3l
5
3
3r
4
a
16
21
18
22

ROLLER SKATE AND WHEEL FOR USE ON SUCH A ROLLER SKATE

This application is a continuation of U.S. patent application Ser. No. 09/178,149 filed on Oct. 23, 1998, now granted as U.S. Pat. No. 6,113,112, which is a continuation-in-part of U.S. patent application Ser. No. 08/578,589 filed on Feb. 12, 1996, now abandoned, that claimed the benefit of the filing date of PCT Application No. AT95/00089 filed on May 5, 1995, designating the United States and published under PCT Article 21(2) in a non-English language.

The present invention relates to an in-line roller skate, which comprises a frame connected to a shoe or a plurality of frame portions which can be attached to this shoe, wherein at least three running rollers are disposed one behind the other in the running direction on the frame or the frame portions and said running rollers comprise along their periphery in each case a rolling surface which extends in a curved manner in an axial cross-section and which is formed in each case substantially symmetrical with respect to the longitudinal middle plane of the running rollers, wherein the rolling surfaces of at least one front running roller and at least one rear running roller with respect to an axis-parallel tangential plane to the rolling surface comprise at a spaced disposition from the longitudinal middle plane a: comparatively greater perpendicular spacing than the. rolling surface at least of a middle running roller, so that when the roller skate tilts sidewards with respect to the tangential plane the front and/or rear running roller are raised from a contact surface or the contact pressure of these running rollers on the contact surface is reduced.

The present invention also relates to a set of running rollers.

In-line roller skates are already known and are commercially available in a large number of different designs. The running rollers of known roller skates are disposed one behind the other in a horizontal plane and generally comprise a rolling surface which is parabolic in the axial cross-section, wherein all running rollers of a roller skate are substantially identical.

In contrast thereto U.S. Pat. No. 5,207,454 A (Blankenburg) describes a roller skate wherein a single running roller is provided in the middle between the front and rear end of the frame and provided in front of and behind this running roller in each case are two ball rollers which are mounted by way of a ball bearing in a shell-shaped recess in the frame. In contrast to the roller skates mentioned in the introduction the running roller comprises a rectangular-cross-section. The ball rollers can move in any direction so that the roller skater can negotiate particularly narrow curves. This known roller skate is, however, encumbered by poor characteristics with respect to the straight travel, which poor characteristic is naturally undesired.

Furthermore, in the known DE 39 186 17 A (K. K. Gakushu Kenkyuscha) an exemplified embodiment of a roller skate is described (FIG. 3), wherein two middle running rollers are wider than in each case two front and rear running rollers. When viewed from the side, the total of six running rollers are disposed along a concave curve. The rolling surface of all six running rollers is designed in the form of a cylindrical peripheral surface and therefore does not comprise any convex curvature. The two wider middle rollers are to ensure that the roller skate runs in a more stable manner since when traveling in a straight line only these two rollers contact the ground. However, this feature is also inadequate for achieving stable travel in a straight line since in this case only two adjacent rollers of the six rollers contact the ground.

One problem which still needs to be overcome when developing in-line roller skates relates to the improvement of the inefficient manner in which such roller skates negotiate curves.

It is known in this connection to provide running rollers with a steerable suspension or to provide a so-called inner-steering for the running wheels in the region of the rotational axis. Although such structural features render it possible to achieve good steering behaviour, they are complicated and expensive.

A further known feature for improving the manner in which in-line roller skates negotiate curves resides in the fact that the foremost and rearmost wheels are disposed slightly higher than the middle wheels, wherein, however, the disadvantage of less efficient travel in a straight line must be accepted. For other in-line roller skates available on the market it is possible to adjust the distance to the ground in such a manner that in one case all running rollers lie on the same height or that in an other case there is adjusted a so-called "rockering" position with the front and/or rear running rollers higher than the middle running rollers.

Commercially available roller skates comprise a rolling surface with a continuous convex profile in the cross-section. Various published documents, e.g. U.S. Pat. No. 698,110 A (Foy), DE 11 100 60 C (Steiger) or GB 908,566 (Lambert) do, however, also disclose other profile shapes, e.g. combinations of convex and concave profile portions which merge into each other by way of a turning point or a transitional edge. Each roller skate does, however, comprise two identical rollers. Furthermore, DE-PS 827 913 (Maassen) describes a roller skate having two running wheels, wherein two wheels having a rolling surface which is circular in cross-section can be replaced by two wheels having a rolling surface which is rectangular in cross-section.

U.S. Pat. No. 2,570,349 A (Kardhordo, according to FR 959 408 A) discloses a roller skate having one single main roller and two or more auxiliary rollers. In this document it is stated, that in curve racing the main roller and one or more auxiliary rollers contact the race course simultaneously, and it is clear, that depending if there is a forward or a backward lean, it is the front or the rear roller which contacts the course surface. However, essential problems are associated with this skating technique in practice. Changing from one roller to two rollers unavoidably causes a tilting movement forward and backward respectively, and furthermore—because of the widely differing rolling surfaces of the rollers contacting the ground—the direction of motion changes in different ways, unexpected for the skater, depending if the front auxiliary roller or the rear auxiliary roller contacts the ground. The center of gravity of the skater will be always either in front of or behind the main roller resulting in the fact that a stable position cannot be reached at any time. Since the rolling surfaces of all rollers merge discontinuous into the lateral surface forming a sharp edge a sudden and dangerous change in road behaviour takes place starting from a certain angular position of the roller skates.

An object of the invention is therefore to improve the manner in which in-line roller skates negotiate curves by means of convenient and inexpensive features without having an adverse effect on the travel in a straight line, e.g. by "rockering", and to provide a set of running rollers for such in-line roller skates. Furthermore a highly tilted position of the roller skate should be possible without sudden changes in road behaviour.

For solving the problem the invention provides an in-line roller skate as mentioned in the beginning, which is characterized in that provided in the middle portion of the roller skate are two middle running rollers which are disposed immediately one behind the other and whose rolling surfaces are identical, wherein these rolling surfaces comprise in the transition region to the lateral surfaces of the running rollers in each case a rounded running shoulder which in the event of a sidewards tilting of the roller skate contacts the contact surface.

By virtue of this feature when travelling in a straight line generally all running rollers are in contact with the substrate, whereas when the roller skate is tilted sidewards the front and rear running roller is raised from the substrate or at least their contact pressure is reduced and thus it is possible to negotiate the curve in a more convenient manner.

In one advantageous embodiment of the invention it is provided that the running shoulder of the rolling surface of a middle running roller comprises a comparatively greater curvature than the remaining central section of the rolling surface of the same running roller. This results in good running properties when negotiating curves. The curvature of the central section of the rolling surface may be zero.

To further facilitate negotiating of curves it is possible that the rolling surface of the at least one front and at least one rear running roller is comparatively narrower in width at a spaced position from its contact surface than the rolling surface of the at least one middle running roller. This renders it possible in an advantageous manner to use identical bearing parts for all types of rollers, because the wheel bodies of the front and the rear rollers may have the same thickness in the region of their axes.

Another solution to the object of the invention may be reached by a set of rollers consisting of one front and one rear roller and two middle rollers having the features as mentioned above.

Figures 2, 3, 4, 5:
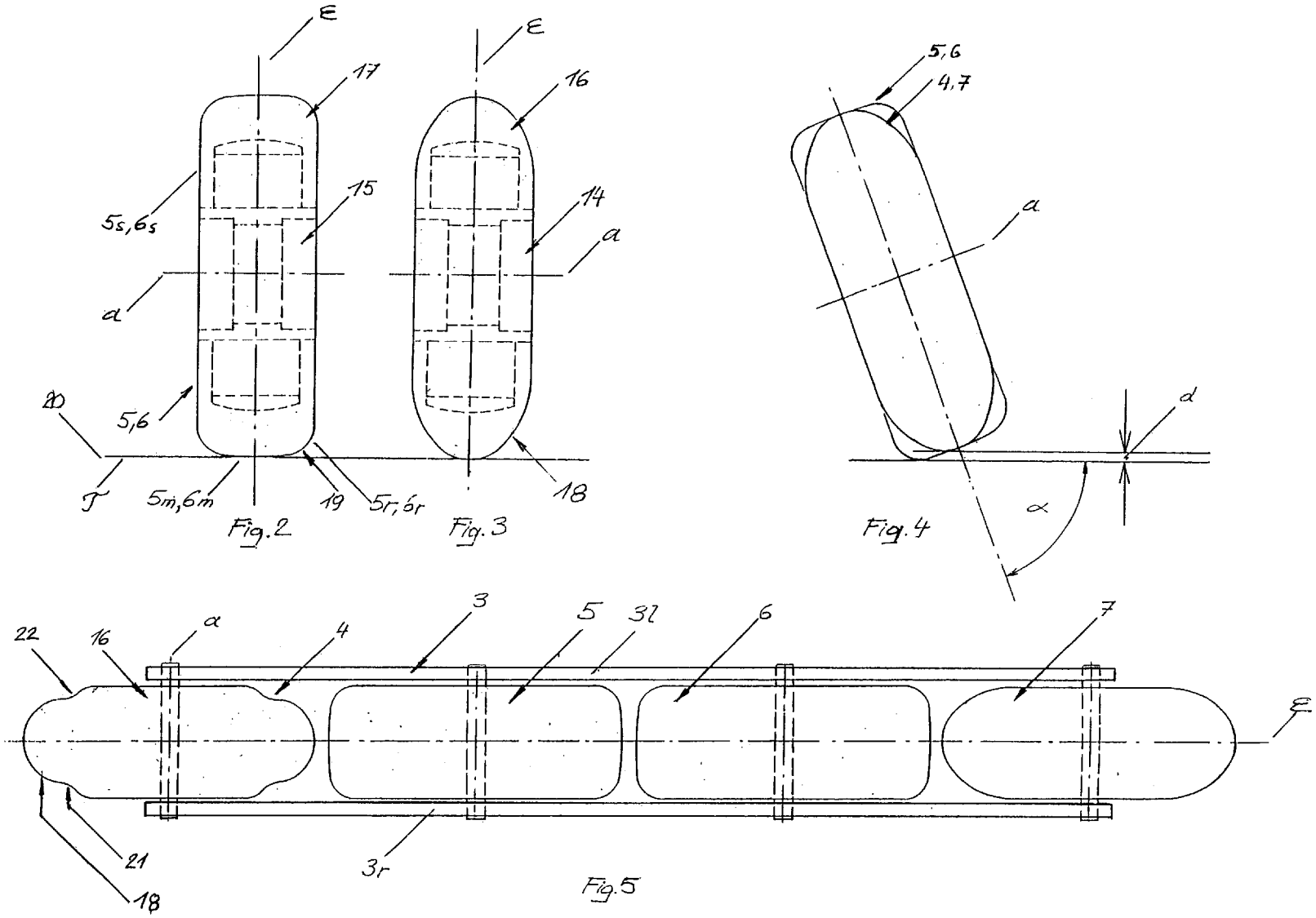

Hereinunder different, non-limiting exemplified embodiments for a roller skate in accordance with the invention are further explained, wherein reference is made to the attached figures, in which:

FIG. 1 shows a schematic lateral view of a roller skate in accordance with the invention, FIGS. 2 and 3 show an axial sectional view through a middle running roller (FIG. 2) and through a front or rear running roller (FIG. 3) for a roller skate in accordance with the invention, FIG. 4 shows a schematic illustration of the rolling surfaces of a middle and a front or rear running roller when tilting the skate and FIG. 5 shows a schematic view from below of a frame for a roller skate in accordance with the invention.

Firstly, reference is made to FIG. 1 in which a roller skate 1 is illustrated which comprises a frame 3 connected to a shoe 2 on which frame are disposed four running rollers 4,. 5, 6, 7 one behind the other in the running direction. The running rollers are attached by means of transverse bolts 8, 9, 10, 11 at corresponding transverse bores in the frame 3, wherein the foremost running roller 4 and the rearmost running roller 7 are disposed on this frame 3 in such a manner that they can be height adjusted by way of an eccentric disc 12, 13 respectively.

FIGS. 2 and 3 illustrate the running rollers 4 and 7 or 5 and 6 in an axial cross-sectional view. It is evident in these sectional illustrations that each running roller 4, 5, 6,7 comprises a cylindrical bearing part 14, 15 which is connected to a wheel body 16, 17 by way of a bearing [not illustrated here], e.g. a ball bearing, on which wheel body is provided along the outer periphery a rolling surface 18, 19 which is designed symmetrically with respect to the longitudinal middle plane & and which lies in. the region of this longitudinal middle plane s on a planar contact surface 20 which forms an axis parallel tangential plane $\tau$ with respect to the rolling surface 18, 19 of each running roller 4, 5, 6, 7.

The essential difference between the running rollers 4, 7 and 5, 6 resides in the special shaping of the rolling surfaces 18 and 19 wherein the rolling surface 18 of the front and rear running rollers 4, 7 comprises at a predetermined spaced position from the longitudinal middle plane a greater perpendicular spacing with respect to the tangential plane $\tau$ than the middle running rollers 5, 6. In the case of the exemplified embodiment illustrated in FIGS. 2 and 3 the different perpendicular spacing with respect to the tangential plane $\tau$ is produced by virtue of the fact that the convex rolling surfaces 18 comprise at a spaced disposition from the longitudinal middle plane $\epsilon$ a smaller curved radius than the likewise convex rolling surface 19. The term concave and convex used below always refers to the axis a of the running rollers 4, 5, 6,7.

Further it can be seen that the rolling surface 19 of each middle running roller 5, 6 (FIG. 2) comprises in the transition region to each lateral surface 5*s*, 6*s* in each case a rounded running shoulder 5*r*, 6*r* that contacts, as explained in detail later, the contact surface 20 when the roller skate is tilted sidewards. The running shoulder 5*r*, 6*r* of the rolling surface 19 of each middle running roller 5, 6 comprises a comparatively greater curvature than the remaining central section 5*m*, 6*m* of the rolling surface 19 of the same running roller 5, 6.

It can be seen from FIG. 4, that the running rollers 5, 6 are no longer directed under 90° to the contact surface 20 when the roller skate is tilted sidewards, but under an angle of $\alpha<90°$, whereby $\alpha$ may be even less than 45°. Further it can be seen that now the front and/or rear running roller 4, 7 is raised from the contact surface 20 by a distance d. As shown in FIG. 5 for the front running roller 4 the convex rolling surface 18 of the front or rear running roller 4, 7 becomes in the direction of the axis a of the running rollers at both sides of the longitudinal middle plane e a concave lateral surface portion 21, 22 of the wheel body 16, wherein the wheel body 16 of a front or rear running roller 4, 7 at its portion facing the axis a is substantially the identical width as the wheel body 19 of a middle running roller 5, 6. This renders it possible in an advantageous manner to use identical bearing parts 14, 15 for both types of running rollers. Furthermore running rollers 4, 5, 6, 7 of a roller skate in accordance with the invention can be retrofitted into conventional roller skates.

FIG. 5 illustrates a conventional, commercially available frame 3 which comprises parallel lateral walls 31, 3r having a constant inner spacing. Such a frame 3 is preferably provided with running rollers 4, 5, 6, 7 whose bearing parts 14, 15 and wheel body 16, 17 are all of an identical width. The running rollers can be manufactured from all suitable materials in any desired width. Moreover, running rollers of the type in accordance with the invention having different steering mechanisms e.g. an inner wheel steering of an elastic suspension, a steerable suspension of a height adjustment etc. can be combined in order to improve the steering effect.

What is claimed is:

1. An in-line roller skate assembly comprising: a frame connected to a shoe and at least three running rollers which are substantially equal in diameter and are disposed one behind the other in a running direction of the skate, the running rollers being rotatably mounted on said frame and including a front roller, a rear roller, and at least one intermediate roller between said front and rear rollers, said front roller having a convex shaped rolling surface with a pair of laterally spaced curved shoulder portions having a common radius of curvature as defined in a plane intersecting a rotational axis of said front roller, said rear roller having a convex shaped rolling surface with a pair of laterally spaced curved shoulder portions as defined in a plane intersecting a rotational axis of said rear roller, and said at least one intermediate roller having a rolling surface and the at least one intermediate roller having a cylindrically shaped central portion and a pair of laterally spaced curved shoulder portions as defined in a plane intersecting a rotational axis of said at least one intermediate roller, the radius of curvature of said curved shoulder portions of said front and rear rollers being greater than a radius of curvature of each curved shoulder portion of said intermediate roller.

2. The in-line roller skate assembly according to claim 1, wherein said curved shoulder portions of said at least one intermediate roller form part of a running shoulder of said rolling surface, and said running shoulder having a curvature greater than that of said cylindrically shaped central portion of said intermediate roller.

3. The in-line roller skate assembly according to claim 1, wherein said pair of laterally spaced curved shoulder portions of said front and rear rollers form part of a running shoulder of said rolling surface of said front and rear rollers, and said rolling surfaces are narrower in width than the rolling surface of the at least one intermediate roller.

4. The in-line skate assembly according to claim 1, wherein the rolling surface of the said front running roller or rear running roller in a vertical longitudinal middle plane comprises a generally convex middle surface portion, and a concave lateral surface portion on both sides of said vertical longitudinal middle plane passing through all of said rollers in said in-line roller skate assembly.

5. An in-line roller skate wheel assembly for attachment to a shoe, the in-line roller skate wheel assembly comprising: a frame and at least three running rollers which are substantially equal in diameter and are disposed one behind the other in a running direction of the skate, the running rollers being rotatably mounted on said frame and including a front roller, a rear roller, and at least one intermediate roller between said front and rear rollers, said front roller having a convex shaped rolling surface with a pair of laterally spaced curved shoulder portions having a common radius of curvature as defined in a plane intersecting a rotational axis of said front roller, said rear roller having a convex shaped rolling surface with a pair of laterally spaced curved shoulder portions as defined in a plane intersecting a rotational axis of said rear roller, and said at least one intermediate roller having a rolling surface , and the at least one intermediate roller having a cylindrically shaped central portion and a pair of laterally spaced curved shoulder portions as defined in a plane intersecting a rotational axis of said at least one intermediate roller, the radius of curvature of said curved shoulder portions of said front and rear rollers being greater than a radius of curvature of each curved shoulder portion of said intermediate roller.

6. The in-line roller skate wheel assembly according to claim 5, wherein said curved shoulder portions of said at least one intermediate roller form part of a running shoulder of said rolling surface, and said running shoulder having a curvature greater than that of said cylindrically shaped central portion of said intermediate roller.

7. The in-line roller skate wheel assembly according to claim 5 or 6, wherein said pair of laterally spaced curved shoulder portions of said front and rear rollers form part of a running shoulder of said rolling surface of said front and rear rollers and said rolling surfaces are narrower in width than the rolling surface of the at least one intermediate roller.

8. The in-line skate roller wheel assembly according to claim 5 or 6, wherein the rolling surface of the said front or rear running rollers in a vertical longitudinal middle plane comprises a generally convex middle surface portion, and a concave lateral surface portion on both sides of said vertical longitudinal middle plane passing through all of said rollers in said in-line roller skate wheel assembly.

* * * * *

UNITED STATES PATENT AND TRADEMARK OFFICE

CERTIFICATE OF CORRECTION

PATENT NO. : 6,443,463 B1
DATED : September 3, 2002
INVENTOR(S) : Kubelka

It is certified that error appears in the above-identified patent and that said Letters Patent is hereby corrected as shown below:

Title page,
Item [73], Assignee, "Mark Handels, AG" should read -- MRK Handels, AG. --

Signed and Sealed this

Twenty-second Day of June, 2004

JON W. DUDAS
*Acting Director of the United States Patent and Trademark Office*